US006492604B1

(12) United States Patent
Maeder et al.

(10) Patent No.: US 6,492,604 B1
(45) Date of Patent: Dec. 10, 2002

(54) DEVICE FOR DETECTING PRESSURE AND PASSAGE OF A VEHICLE WHEEL ON A PAVEMENT USING A CONDUCTIVE RUBBER AND METHOD FOR INSTALLING SAME

(75) Inventors: Claude Maeder, Nancy (FR); Régis Rollin, Saulxures les Nancy (FR)

(73) Assignee: Electronique Controle Mesure, Vandoeuvre les Nancy (FR)

( * ) Notice: Subject to any disclaimer, the term of this patent is extended or adjusted under 35 U.S.C. 154(b) by 0 days.

(21) Appl. No.: 09/700,613

(22) PCT Filed: Mar. 15, 2000

(86) PCT No.: PCT/FR00/00617

§ 371 (c)(1),
(2), (4) Date: Feb. 5, 2001

(87) PCT Pub. No.: WO00/57442

PCT Pub. Date: Sep. 28, 2000

(30) Foreign Application Priority Data

Mar. 19, 1999 (FR) ..... 99 03555

(51) Int. Cl.[7] ..... H01H 3/02
(52) U.S. Cl. ..... 200/86 A; 200/86 R
(58) Field of Search ..... 200/85 R, 86 A, 200/511, 86.5

(56) References Cited

U.S. PATENT DOCUMENTS

| | | | | | |
|---|---|---|---|---|---|
| 3,553,404 | A | * | 1/1971 | Koenig | 200/85 |
| 4,839,480 | A | * | 6/1989 | Bickley | 200/86 A |
| 4,987,277 | A | * | 1/1991 | Duhon | 200/86 R |
| 5,448,232 | A | * | 9/1995 | Tyburski | 340/933 |
| 5,463,385 | A | * | 10/1995 | Tyburski | 340/933 |

FOREIGN PATENT DOCUMENTS

| | | |
|---|---|---|
| DE | 9407645 | 7/1994 |
| DE | 29605719 | 7/1997 |
| DE | 29805058 | 6/1998 |
| EP | 0539887 | 5/1993 |
| FR | 2634926 | 2/1990 |

* cited by examiner

*Primary Examiner*—Elvin Enad
*Assistant Examiner*—Lisa N Klaus
(74) *Attorney, Agent, or Firm*—Gary M. Cohen

(57) ABSTRACT

A system for detecting the pressure and passage of a vehicle wheel on a surface includes an element made of a deformable conductive rubber component which is urged into contact with an opposing conductive metal component by the passage of a wheel over the element. The rubber component is maintained in a bracket having a generally square profile, and the element is connected to a two-conductor cable through a connection made of an insulating material.

18 Claims, 5 Drawing Sheets

DEVICE FOR DETECTING PRESSURE AND PASSAGE OF A VEHICLE WHEEL ON A PAVEMENT USING A CONDUCTIVE RUBBER AND METHOD FOR INSTALLING SAME

BACKGROUND OF THE INVENTION

The present invention relates to an electronic device for detecting the weight or passage of objects, to methods for installing such devices, and to applications of such devices to detection of the passage of or the presence of vehicle wheels.

A number of systems are already known for detecting vehicle axles or wheels. For example, it is known to carry out measurements for detecting axles using pneumatic tubes. Pressure variation inside the tubes is measured during the passage of an axle. Such systems are sensitive to pressure variation, but they cannot easily detect the presence of an axle.

Also known are devices which include two deformable metal blades adhesively bonded to, or held by any other means against, two opposed faces of a rubber component. The metal blades are separated by an air gap, and form a mechanical switch. When an object bears on the rubber component, the rubber component deforms, making a metal/metal contact which serves as the switch.

This system has a number of drawbacks, such as the difficulty of adhesively bonding mechanical components to rubber, which can considerably reduce the lifetime of the system. Moreover, such systems are extremely rigid along their length, making them barely deformable. As a result, it becomes very difficult to install or replace the sensors in a metal support component without an adhesive bonding or a mechanical mounting.

Systems are also known for measuring variations in resistance in layers of carbon-filled foam. These components have the drawback of having long response times, which can vary over time due to their aging.

Systems are also known (for example, from French Patent No. 2 634 926) which make use of a detection device having, on one side of the device, two elongate, fixed conductors placed opposite an elongate component made of a deformable conductive rubber.

SUMMARY OF THE INVENTION

The system of the present invention improves upon the system described in French Patent No. 2 634 926. To this end, a pressure-sensitive electrical switch is provided which uses the properties of a carbon-filled rubber, or other conductive element, for making the component electrically slightly resistive. The resulting sensors use a measurement of the electrical resistance between a partially insulated steel blade and a slightly resistive rubber component during the passage of vehicles.

The present invention also relates to techniques for installing the sensor (i.e., the device intended to receive the sensor), which can be anchored into the roadway by any known means, and to fitting and dismantling techniques which are made possible by the flexibility of the detection sensor.

Further characteristics and advantages will appear in the course of the description which follows.

DETAILED DESCRIPTION OF THE INVENTION

Figure 1:
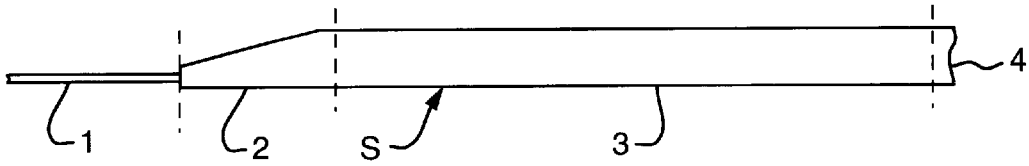
FIG. 1 is a side view of a sensor which is produced in accordance with the present invention.

An overall view of the sensor S, which comprises four main components, is shown in FIG. 1. A two-conductor cable (1) is provided for transmitting measurements of the resistance of the sensor S. A connection part (2) is provided for interconnecting the cable (1) and both an electrically slightly resistive rubber and a partially insulated metal piece, which will be described more fully below. An active part of the sensor S is shown at (3), and a cap (4) is provided for sealing the entire sensor.

Figure 2A:
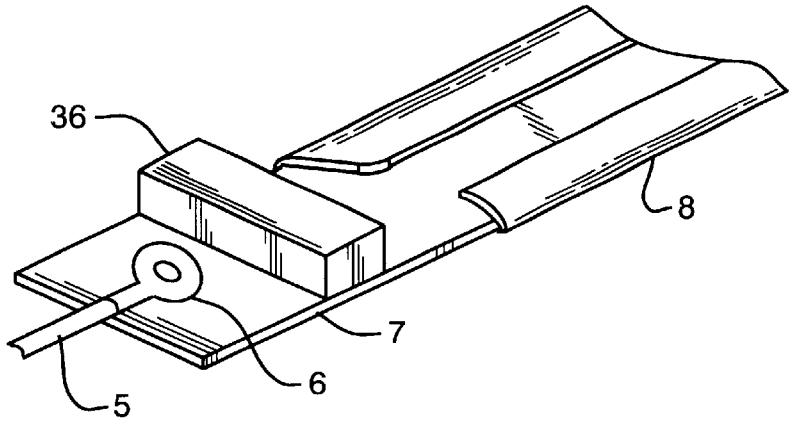
FIG. 2A is an isometric view of internal portions of the sensor, showing the connection between the cable and the partially insulated metal component.
Figure 2B:
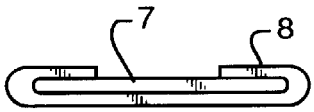
FIG. 2B is a cross-sectional view of the insulated portions of the metal component.
Figure 3:
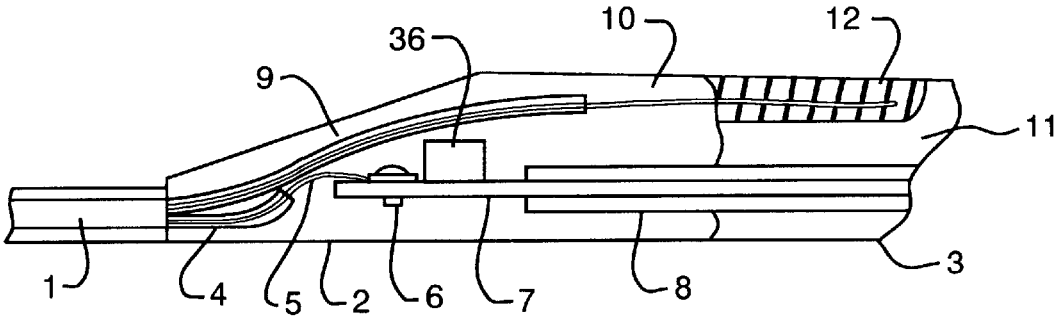
FIG. 3 is a sectional view showing the connection between the various components of the sensor.

FIGS. 2A, 2B and 3 describe the connection between these various components. A sensing component (7) is provided which is formed as a very long, narrow conducting metal strip. The component (7) is partially insulated by an electrical insulation (8), which covers the lower part of the metal strip (7), which partially covers the upper part, and which completely covers the two sides. A protuberance (36), or any other distortion, allows the mechanical component (7) to be held in place in the molding which forms the connection part (2) so as to be able to withstand longitudinal forces due to the passing of the wheels of a vehicle.

The electrical conductor (5) comes from the cable (1) (a two-conductor cable) and is insulated over part of its length by the component (4). The metal component (7) is connected to the cable (5) by a circular connector (6), which is mechanically crimped after the strip (7). A conductor (10), which is stripped of its insulator (9), is inserted into a slightly resistive rubber component (11) by means of a molded or an adhesively bonded component (12) made of a slightly conductive rubber.

The assembly (2) is molded by injection molding, or another process, using an electrically insulating rubber.

Figure 4A:
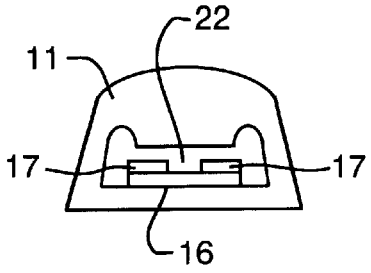
FIG. 4A (PRIOR ART)
FIG. 4A is a cross-sectional view of the sensor as described in French Patent No. 2 634 926.

The active part of a previously known sensor (as described in prior French Patent No. 2 634 926) is shown in FIG. 4A. The component (11) is made of a slightly resistive, carbon-filled rubber. The component (16) is an electrically insulating component, and the two components (17) are metal conductors. When a vehicle passes over the component (11), the component (11) deforms and comes into contact with the two components (17), making the resistance between the two components (17) extremely low. This resistance is infinite when unstressed, since the two conductors are insulated by a layer of air (22).

Figure 4B:
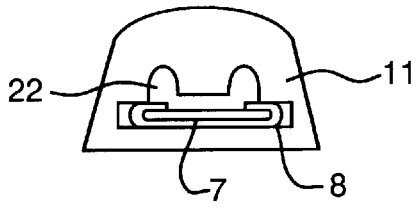
FIG. 4B is a cross-sectional view of the sensor of the present invention.

FIG. 4B shows an active part which is produced in accordance with the present invention. The active part is modified from the active part shown in FIG. 4A, and includes the metal component (7), which is insulated by the component (8) on the lower face, the sides and part of the upper face. The component (11) is made of electrically slightly resistive rubber. When the component (11) deforms due to the effect of a passing wheel, the component (11) comes into contact with the metal plate (7). The electrical resistance between the component (7) and the component (11), which is measured by the conductors (5, 10) will decrease from infinity to a very low value of between a few hundred ohms and a few tens of kilohms.

The industrial manufacture of a sensor according to FIG. 4B is facilitated by the existence of a gap between the component (8) and the interior of the component (11). The components (7, 8, 11) are manufactured by extrusion or by any other known process. The cap (4) (FIG. 1) makes it possible to seal the part (22), and the air gap existing between the components (7, 8) and the interior of the component (11). This sealing prevents the metal component (7) from oxidizing.

The component (2) (FIG. 1), which is made of an electrically insulating rubber, and the component (3) (FIG. 1), which is made of an electrically slightly resistive rubber, are joined together during hot molding (under pressure of the component 12), or any other known process, to connect the cable (10) to the section (12). The cap (4) is fastened to the component (3) by hot molding, with pressure, or by any other known process.

Figure 5:
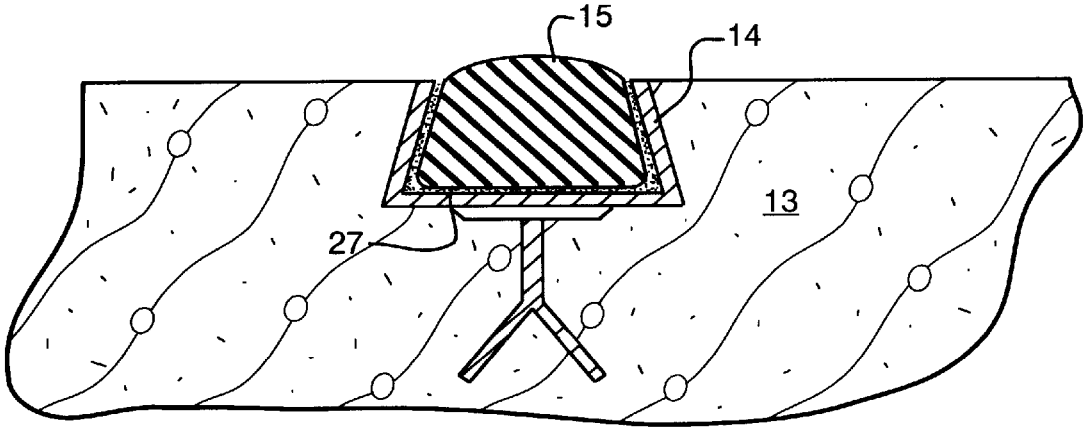
FIG. 5 is a cross-sectional view of the sensor installed in its support, which is anchored into the roadway.

FIG. 5 illustrates the installation of a support (14), which is made of a nonoxidizable material (e.g., stainless steel, or a component made of a nonoxidizable plastic or composite) in a roadway (13), which is generally made of concrete or asphalt. The support (14) houses the sensor (15), which is press-fit into and generally adhesively bonded to the lower part of the support (14) by an elastic adhesive (27).

Figure 6:
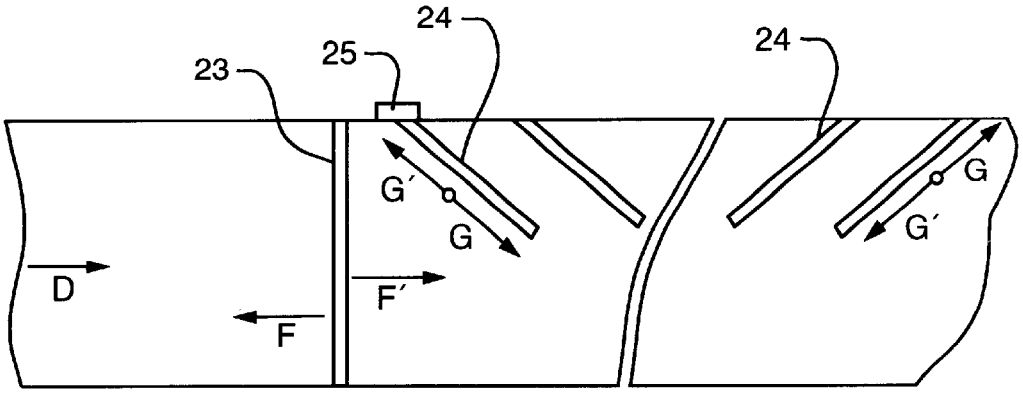
FIG. 6 is a schematic plan view, from above a toll lane in which sensors of the present invention are fitted, subjecting the sensors to the loads of vehicles with wheels that are accelerating or decelerating.

The adhesive bonding is made necessary by the existence of longitudinal forces on the sensor. These forces are illustrated in FIG. 6, which shows the position of an axle-detecting sensor (23) in a toll lane. Vehicles pass along the lane in the direction D, and the sensor (23) is positioned for counting wheels or axles, along its length. Wide or twin wheels are detected in otherwise known fashion using additional sensors (24) which are inclined at an angle of between 30 and 60°. When vehicles pass over the sensors (23), the sensors (23) are subjected to forces F or F' which depend on whether the vehicle is accelerating or decelerating. These forces will have a tendency to pull the sensor out of the support.

Figure 11A:
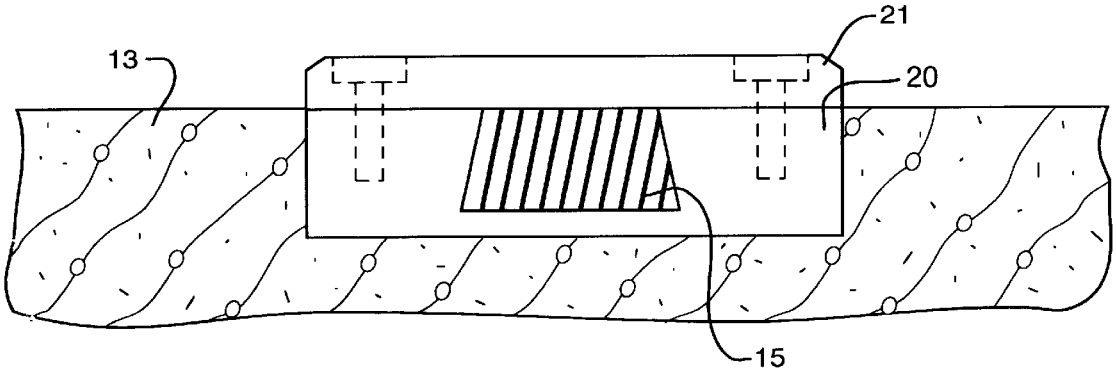
FIGS. 11A and 11B are cross-sectional views showing the clamp for fastening and holding the sensor, forming an integral part of the support shown in FIGS. 9, 10A and 10B.
Figure 11B:
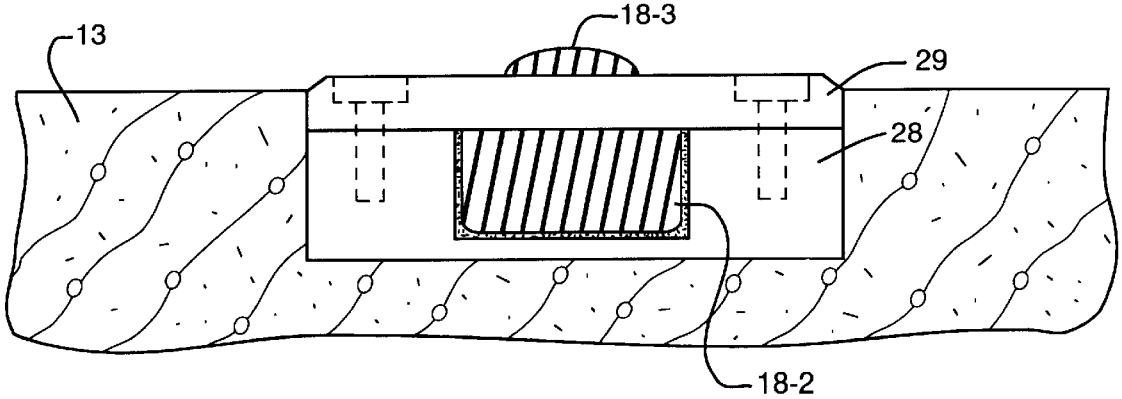

As vehicles pass, the sensors (24) are subjected to a longitudinal force G or G' which will tend to make the sensor slip and leave its support. These forces are, of course, reversed if the vehicle changes direction. The position of the sensors (24) will be chosen according to the desired distribution of the reactions to the forces created (G or G'). It is possible, for example, to adhesively bond the lower part of the sensor (24) (e.g., in the lower part between the sensor (15) and the support (14) shown in FIG. 5) using a suitable elastic adhesive (27). It is also possible to immobilize the sensor (24), at the end (25), by a mechanical system (e.g., formed by a support (20) and mechanical piece (21) placed in the upper part and pressing on the sensor (15), as shown in FIG. 11A).

Figure 7:
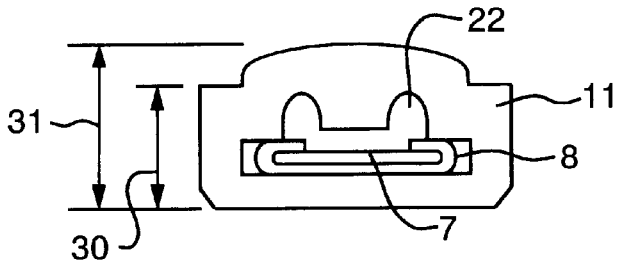
FIG. 7 is a cross-sectional view of a sensor produced in accordance with the present invention.
Figure 8:
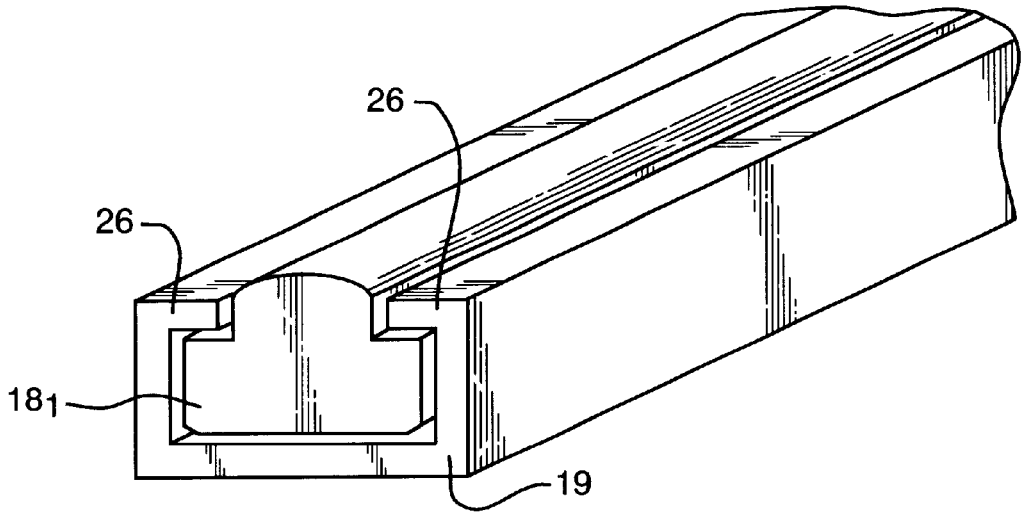
FIG. 8 is a cross-sectional view of a sensor, together with its support, in accordance with the present invention.

FIG. 7 shows another embodiment of the sensor of the present invention. The electrically slightly resistive rubber component (11) has an outer profile suitable for fitting it into the section (19) shown in FIG. 8. The operation of this sensor is identical to the sensor shown in FIG. 4B. The adhesive bonding of the lower part (27) shown in FIG. 5 is replaced with two upper flanges (26) of the section (19).

Figure 9:
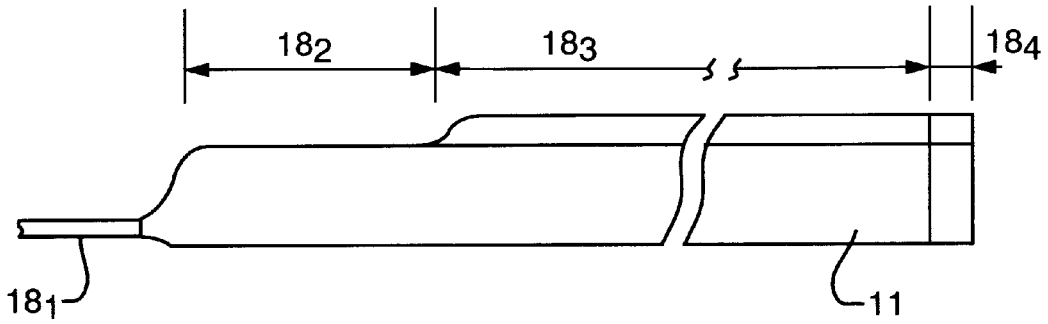
FIG. 9 is a side view of a sensor produced in accordance with the present invention.
Figure 10A:
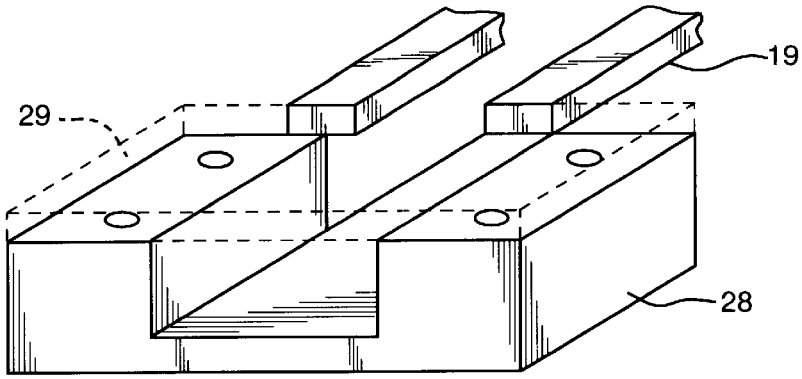
FIG. 10A is an isometric view showing the end part of the support for the sensor.
Figure 10B:
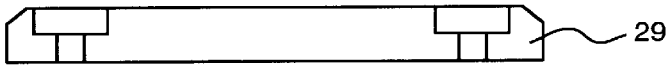
FIG. 10B is a cross-sectional view of the cover for the end part shown in FIG. 10A.

FIG. 9 illustrates a sensor having a resistive rubber component (11) which extends into the active part ($\mathbf{18}_3$). The cap ($\mathbf{18}_4$) is of the same or similar shape to that of the active part ($\mathbf{18}_3$). The connection part ($\mathbf{18}_2$) has an internal structure of the same type as the connection part (2) shown in FIG. 1, but with a thickness which is less than or equal to the height (30) (shown in FIG. 7), so as to allow the sensor to be immobilized by a clamp (29) (shown in FIG. 10B) which is fastened to a part (28) (shown in FIG. 10B) so that the upper face of the clamp (29) does not exceed the overall height (31) (shown in FIG. 7) of the sensor. Consequently, the connection part (18-2) can be installed in the roadway (13), creating only a minimum projection that will present no risk for the vehicles passing along the lane, unlike the sensor with the shape shown in FIG. 4B and the cross-section of the fastening structure which is shown in FIG. 11A.

Figure 12:
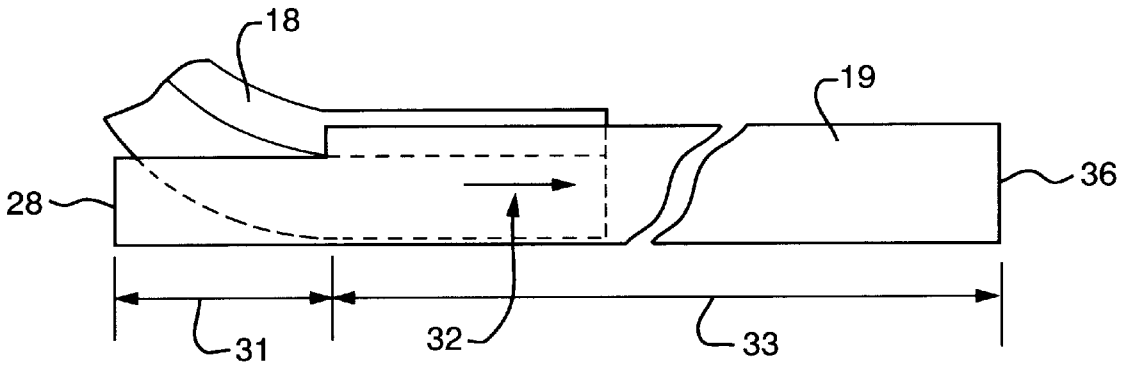
FIG. 12 is a partially sectioned view showing the operation of fitting the sensor into the support.
Figure 13:
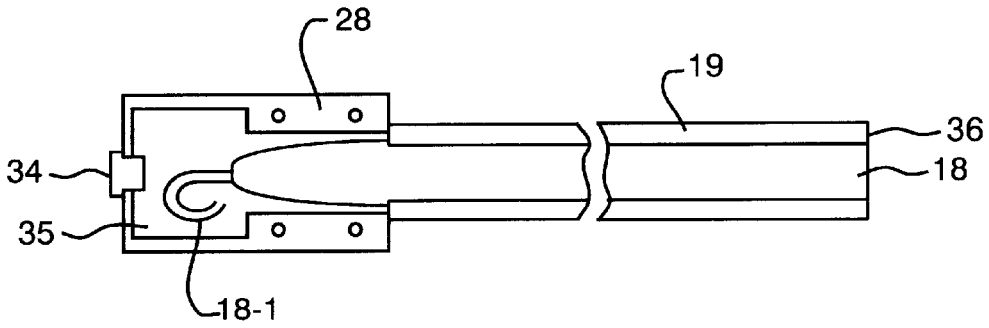
FIG. 13 is a partially sectioned view showing the sensor as it is normally installed in its support.

The technique of installing the sensor (18) in the support (19) is described in FIG. 12. This technique is made possible because of the internal construction of the sensor, which makes the sensor very flexible. Moreover, a functional gap (shown in FIG. 8) can be provided between the sensor (18) and the support (19) to allow the sensor (18) to slide in the support (19) by exerting a moderate force (32). The necessary entranceway (31) for inserting the sensor (18) into the support (19) is about 100 to 200 millimeters. As is shown in FIG. 13, once the sensor has been installed, it is pushed to the end (36) of the support (19) and the cable (18-1) is installed as it passes (either via the lower part (35) of the end of the support, on the clamp side, or via a gland (34) fastened to the support).

Figure 14:
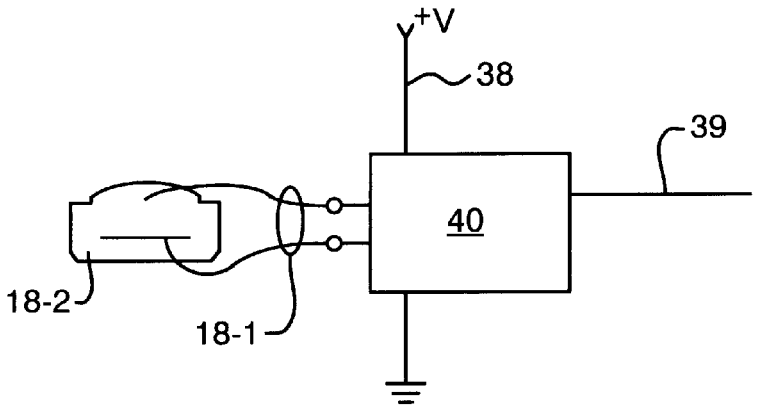
FIG. 14 is a schematic view showing an electronic circuit capable of converting variations in the resistance of the sensor into an on/off signal corresponding to the presence or absence of an object on the sensor.

FIG. 14 illustrates electrical connection of the sensor with a circuit (40), which is itself known, for receiving signals from the sensor. To this end, the circuit (40) detects variations in the resistance of the sensor (18-2), which is electrically connected to the circuit (40) by the conductors (18-1). The circuit (40), which is supplied with a voltage V at (38), operates to deliver a 0/V on/off signal at (39).

What is claimed is:

1. A device for detecting passage of vehicle wheels over a roadway, comprising:

a hollow rubber section having a low electrical resistance, mated with a U-shaped support which is partially closed along an upper part of the support, so that the hollow rubber section slightly projects from the U-shaped support;

wherein the hollow rubber section includes a metal strip with insulation on a lower face of the strip, on sides of the strip, and on portions of the upper face of the strip;

wherein the metal strip with the insulation is received in the hollow rubber section opposite an inner surface of the hollow rubber section;

wherein the inner surface is separated from the metal strip by an air gap so that when unstressed, a high resistance is established between the strip and the hollow rubber section, and so that a low resistance is established between the strip and the hollow rubber section when a mechanical force is applied to an outer surface of the hollow rubber section; and wherein the hollow rubber section is formed of a deformable rubber so that the mechanical force deforms the hollow rubber section and produces the low resistance between the hollow rubber section and the metal strip, and so that the high resistance between the hollow rubber section and the metal strip is produced after the mechanical force is removed; and a transmission cable communicating with the device, wherein the transmission cable is a two-conductor cable having a first conductor which is mechanically connected to the metal strip and which is overmolded by an insulating rubber component, and a second conductor having an uninsulated portion which is embedded in an electrically slightly resistive rubber component, and a rubber component overmolded on an end of the device which is opposite to the transmission cable to close the device.

2. The device of claim 1 wherein internal sensing portions of the device are sealed from an external environment by an electrically insulating material overmolding the two-conductor cable at one end of the hollow rubber section and overmolding the rubber component on an opposite end of the hollow rubber section.

3. The device of claim 1 wherein the metal strip with the electrical insulation and the deformable rubber of the hollow rubber section form an active part contained between upper and lower portions of the partially closed U-shaped support.

4. The device of claim 1 wherein the upper portions of the U-shaped support are partially closed by a pair of flanges.

5. The device of claim 1 wherein the U-shaped support is formed of a nonoxidizable and nondeformable material.

6. The device of claim 5 wherein the material forming the U-shaped support is a metal.

7. The device of claim 5 wherein the material forming the U-shaped support is a plastic.

8. The device of claim 5 wherein the material forming the U-shaped support is a composite material.

9. The device of claim 1 wherein the device is flexible, wherein the U-shaped support is nondeformable, and wherein the flexible device is received in the nondeformable U-shaped support.

10. The device of claim 1 wherein the U-shaped support has a clamp placed at one end of the support, and wherein the clamp is fastened to the support so that a pressure is placed against the device to immobilize the device.

11. A device for detecting passage of vehicle wheels over a roadway having a surface, wherein the device is coupled with the roadway and comprises:

a hollow rubber section having a low electrical resistance, mated with a U-shaped support which is partially closed along an upper part of the support, so that the hollow rubber section slightly projects from the U-shaped support;

wherein the hollow rubber section includes a metal strip with insulation on a lower face of the strip, on sides of the strip, and on portions of the upper face of the strip;

wherein the metal strip with the insulation is received in the hollow rubber section opposite an inner surface of the hollow rubber section;

wherein the inner surface is separated from the metal strip by an air gap so that when unstressed, a high resistance is established between the strip and the hollow rubber section, and so that a low resistance is established between the strip and the hollow rubber section when a mechanical force is applied to an outer surface of the hollow rubber section; and wherein the hollow rubber section is formed of a deformable rubber so that the mechanical force deforms the hollow rubber section and produces the low resistance between the hollow rubber section and the metal strip, and so that the high resistance between the hollow rubber section and the metal strip is produced after the mechanical force is removed; and a transmission cable communicating with the device, wherein the transmission cable is a two-conductor cable having a first conductor which is mechanically connected to the metal strip and which is overmolded by an insulating rubber component, and a second conductor having an uninsulated portion which is embedded in an electrically slightly resistive rubber component, and a rubber component overmolded on an end of the device which is opposite to the transmission cable to close the device;

wherein the support is installed in the roadway so that the upper part of the support is at substantially the same level as the surface of the roadway, and so that only the outer surface of the hollow rubber section projects above the surface of the roadway.

12. The device of claim 11 wherein the metal strip with the electrical insulation and the deformable rubber of the hollow rubber section form an active part contained between upper and lower portions of the partially closed U-shaped support.

13. The device of claim 12 wherein the active part is contained in the roadway, at a level below the surface of the roadway.

14. The device of claim 13 wherein the upper portions of the U-shaped support are partially closed by a pair of flanges.

15. The device of claim 14 wherein the flanges have upper surfaces which are substantially level with the surface of the roadway.

16. The device of claim 11 wherein the U-shaped support is formed of a nonoxidizable and nondeformable material.

17. The device of claim 11 wherein the device is flexible, wherein the U-shaped support is nondeformable, and wherein the flexible device is received in the nondeformable U-shaped support.

18. The device of claim 11 wherein the U-shaped support has a clamp placed at one end of the support, and wherein the clamp is fastened to the support so that a pressure is placed against the device to immobilize the device.

* * * * *